US010700441B2

(12) United States Patent
Watson

(10) Patent No.: US 10,700,441 B2
(45) Date of Patent: Jun. 30, 2020

(54) CONFIGURABLE WIDE SCAN ANGLE ARRAY

(71) Applicant: Paul Robert Watson, Ottawa (CA)

(72) Inventor: Paul Robert Watson, Ottawa (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 32 days.

(21) Appl. No.: 16/041,339

(22) Filed: Jul. 20, 2018

(65) Prior Publication Data

US 2020/0028277 A1 Jan. 23, 2020

(51) Int. Cl.

| | |
|---|---|
| ***H01Q 21/24*** | (2006.01) |
| ***H01Q 1/38*** | (2006.01) |
| ***H01Q 21/00*** | (2006.01) |
| ***H01Q 21/29*** | (2006.01) |
| ***H01Q 21/28*** | (2006.01) |

(52) U.S. Cl.

CPC ..... *H01Q 21/24* (2013.01); *H01Q 1/38* (2013.01); *H01Q 21/0006* (2013.01); *H01Q 21/28* (2013.01); *H01Q 21/29* (2013.01)

(58) Field of Classification Search

CPC ..... H01Q 21/24; H01Q 21/28; H01Q 21/29; H01Q 21/0006; H01Q 1/38

See application file for complete search history.

(56) References Cited

U.S. PATENT DOCUMENTS

| | | | | |
|---|---|---|---|---|
| 2006/0276135 | A1* | 12/2006 | Tsai | H01Q 3/2605 455/63.4 |
| 2009/0303125 | A1 | 12/2009 | Caille et al. | |
| 2011/0175782 | A1 | 7/2011 | Choi et al. | |
| 2015/0357721 | A1* | 12/2015 | Zimmerman | H01Q 3/26 343/853 |

FOREIGN PATENT DOCUMENTS

| | | | | |
|---|---|---|---|---|
| CN | 101375466 | A | 2/2009 | |
| CN | 108232466 | A | 6/2018 | |
| WO | WO-03007422 | A1 * | 1/2003 | H01Q 9/16 |
| WO | 2008048210 | A2 | 4/2008 | |

OTHER PUBLICATIONS

N.H. Noordin et al., "Low-cost antenna array with wide scan angle property", IET Microwaves, Antennas & Propagation, vol. 6, Issue 15, pp. 1717-1727, Dec. 11, 2012.

S. Mohamad et al., "Wideband Multi-Beam Antenna Apertures Using Metamaterial-Based Superstrates", 2014 IEEE Antennas and Propagation Society International Symposium (APSURSI), Jul. 2014, 2 pages in total.

* cited by examiner

*Primary Examiner* — Hoang V Nguyen

(57) ABSTRACT

An antenna array structure is described that includes at least two antenna arrays co-located on a common planar array reflector. One of the antenna arrays has a first, central scan range. The other antenna array includes antenna elements that can be controlled to scan regions outside of the first, central scan range.

19 Claims, 11 Drawing Sheets

CONFIGURABLE WIDE SCAN ANGLE ARRAY

FIELD

The present disclosure relates to antenna arrays such as beam forming antenna arrays.

BACKGROUND

Adaptive beam forming can be used to optimize the propagation path between a base station antenna array and a terminal such as user equipment (UE). Conventional antenna arrays have a scanning range of approximately +/−40°. Beyond that range, the scanning loss in gain may degrade propagation and also form unwanted side lobes that create interference. Furthermore, at lower frequencies (for example 3.5 GHz or 2.4 GHz), conventional antenna arrays that includes a high number of antenna elements arranged in a planar arrays can require a large physical foot print.

It is desirable to provide a planar antenna array which has the ability to cover an extended beam forming scan range of +/−(40° to 70°) in addition to a conventional scan range +/−40°.

SUMMARY

An antenna array structure is described that includes at least two antenna arrays co-located on a common planar array reflector. One of the antenna arrays has a first, central scan range. The other antenna array includes antenna elements that can be controlled to scan regions outside of the first, central scan range. In at least some examples, the antenna array structure is a planar array that can provide a wider scan angle range and improved gain when compared to conventional antenna array structures of similar size. The planar antenna array structure may in some configurations provide an extended scan angle range and a higher gain over that range, allowing for one or both of a better signal level and a reduction in overall size of the antenna array.

An antenna array structure is disclosed according to a first example aspect. The antenna array structure includes a planar array reflector, a central beam forming antenna array located on the planar array reflector and configured to form radio frequency (RF) signals having a beam peak that is adjustable within a central scan angle range relative to a propagation axis that is normal to the array reflector, and a wide beam forming antenna array located on the surface of the planar array reflector and configured to form RF signals with a beam peak that is adjustable within a wide angle scan range that at least partially exceeds the central scan angle range.

In some example embodiments, the central beam forming antenna array includes an array of antenna elements that are polarized approximately parallel to the array reflector, and the wide beam forming antenna array includes an array of antenna elements that are polarized approximately parallel to the propagation axis and orthogonal to the antenna elements of the central beam forming antenna array. In some examples rows of the antenna elements of the central beam forming antenna array alternate with rows of the antenna elements of the wide beam forming antenna array on the array reflector.

In some example embodiments, the central beam forming antenna array includes a first array of first antenna elements and a second array of second antenna elements, wherein each first antenna element is co-located with a respective one of the second antenna element, the first antenna elements and second antenna elements having different polarizations. The first antenna elements and second antenna elements may be polarized orthogonally to each other. Furthermore, the first antenna elements and second antenna elements may each be dipole antenna elements.

In some example embodiments, the central beam forming antenna array includes antenna elements that are polarized parallel to a plane of the array reflector and that are one of: dipole antenna elements; slot antenna elements; slot coupled patch antenna elements; probe fed patch antenna elements; linear polarized antenna element and circular polarized antenna elements.

In some example embodiments of the first aspect, the wide beam forming antenna array includes antenna elements that are polarized in a direction that is normal to a plane of the array reflector and that are one of: monopole antenna elements; configurable monopole antenna elements having parasitic switchable features; folded monopole antenna elements; inverted F antenna elements; and configurable reversible inverted F antenna elements.

In some example embodiments, the wide beam forming antenna array includes an array of configurable reversible inverted F-antenna units. In some examples, each configurable reversible inverted F antenna (RIFA) unit comprises: a feed portion electrically coupling the RIFA unit to an RF feed; at least a first selective grounding portion and a second selective grounding portion, each selective grounding portion being configured to selectively enable or disable an electrical coupling to a ground plane of the planar array reflector; a first conductive arm providing electrical conduction between the feed portion and the first selective grounding portion, extending from the first selective grounding portion towards the feed portion and extending beyond the feed portion; and at least a second conductive arm providing electrical conduction between the feed portion and the second selective grounding portion, extending from the second selective grounding portion towards the feed portion and extending beyond the feed portion. The feed portion, the first selective grounding portion and the first conductive arm together define a first inverted F antenna (IFA) element of the RIFA unit, the feed portion, the second selective grounding portion and the second conductive arm together define at least a second IFA element of the RIFA antenna unit; the feed portion being common to both the first and at least the second IFA elements.

In some examples, the first and second IFA elements are polarized in a direction that is normal to a plane of the array reflector, and oriented to propagate in opposing directions.

In some examples the array structure comprises a controller configured to independently adjust a phase and an amplitude of an RF signal for each of a plurality of first antenna elements that are included in the central beam forming antenna array and each of a plurality of second antenna elements that are included in the wide beam forming antenna array to cause the antenna array structure to form a collective RF signal having a beam peak that corresponds to a desired propagation angle. In some examples, the controller is configured to use the central beam forming antenna array to form the collective RF signal when the desired propagation angle falls within the central scan angle range and to use the wide beam forming antenna array to form the collective RF signal when the desired propagation angle falls within the wide scan angle range. In some examples, the controller is configured to use both the central beam forming antenna array and the wide beam forming antenna array to form the collective RF signal when the desired propagation angle falls within a scan angle range that is within an overlapping region of the central scan angle range and the wide scan angle range. In some examples, the controller is configured to use only the central beam forming antenna array to form the collective RF signal when the desired propagation angle falls within the central scan angle range and to use only the wide beam forming antenna array to form the collective RF signal when the desired propagation angle falls within the wide scan angle range.

In some examples, the central scan angle range is not more than +/−40° relative to the propagation axis that is normal to the array reflector. In some examples, the wide angle scan range is from not less than 35° to not more than 75° and from not more than −35° to not less than −75° relative to the propagation axis that is normal to the array reflector.

According to another example aspect is a method of transmitting an RF signal using an antenna array structure that includes a planar array reflector, a central beam forming antenna array located on the planar array reflector and configured to form radio frequency (RF) signals having a beam peak that is adjustable within a central scan angle range relative to a propagation axis that is normal to the array reflector, and a wide beam forming antenna array located on the surface of the planar array reflector and configured to form RF signals with a beam peak that is adjustable within a wide angle scan range that at least partially exceeds the central scan angle range. The method includes selecting at least one of the central beam forming antenna array and the wide beam forming antenna array based on a desired propagation angle, and adjusting the amplitude and phase of RF signals provided to antenna elements of the selected antenna array to achieve the desired propagation angle for transmitting the RF signal. In at least some examples, selecting at least one of the central beam forming antenna array and the wide beam forming antenna array based on a desired propagation angle comprises: if the desired propagation angle falls with the central scan angle range then selecting the central beam forming antenna and if the desired propagation angle falls outside of the central scan angle range then selecting the wide scan angle array. In some examples, the central scan angle range is not more than +/−40°.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

The following is a partial list of acronyms and associated definitions that may be used in the following description:

| | |
|---|---|
| WSA | Wide Scan Angle |
| UE | user terminal (equipment) |
| TDD | time division duplexing |
| RIFA | reversible inverted F antenna |

Directional references herein such as "front", "rear", "up", "down", "horizontal", "top", "bottom", "side" and the like are used purely for convenience of description and do not limit the scope of the present disclosure. Furthermore, any dimensions provided herein are presented merely by way of an example and unless otherwise specified do not limit the scope of the disclosure. Furthermore, geometric terms such as "straight", "flat", "curved", "point", "normal", "orthogonal" and the like, and references to direction of polarization, are not intended to limit the disclosure any specific level of geometric precision, but should instead be understood in the context of the disclosure, taking into account normal manufacturing tolerances, as well as functional requirements as understood by a person skilled in the art.

Figure 1:
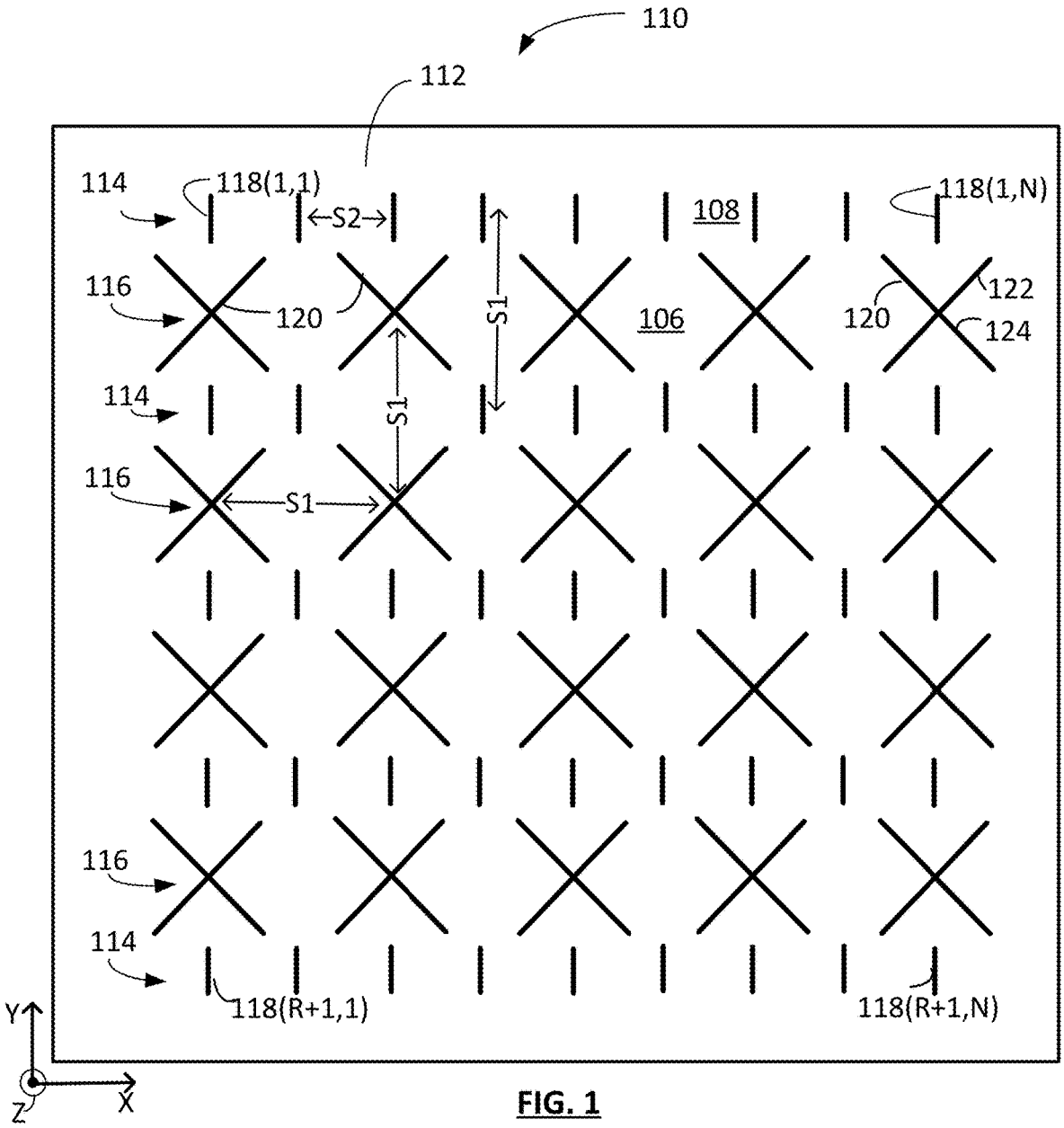
FIG. 1 is a front view of an antenna array structure according to an example embodiment.
Figure 2:
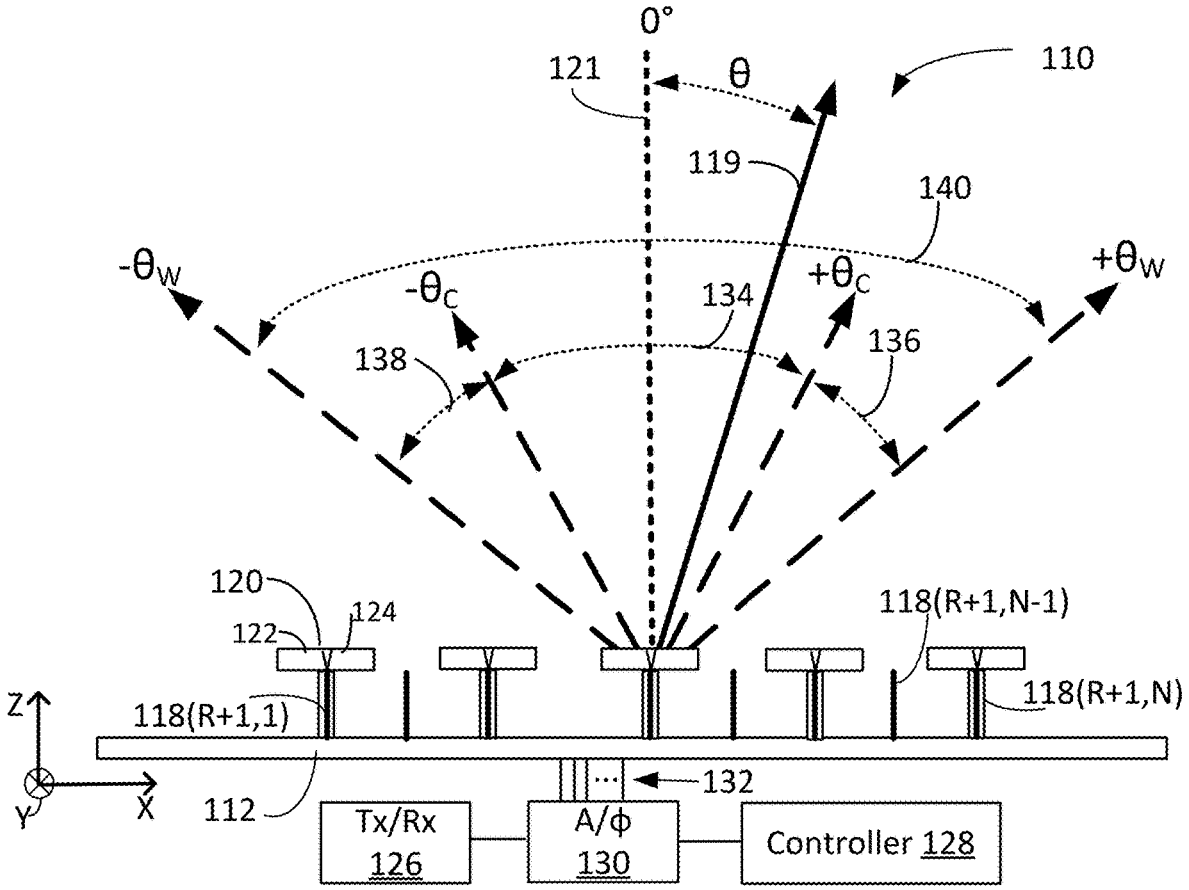
FIG. 2 is a side view of the antenna array structure of FIG. 1.

FIG. 1 and FIG. 2 illustrate front and side views of an antenna array structure 110 according to example embodiments. In example embodiments, antenna array structure 110 may be configured to transmit and receive radio frequency (RF) signals within a predetermined or operating frequency band through a wireless channel. For example, antenna array structure 110 may be part of a base station system or other interface node and used to exchange RF signals using the operating frequency band with user equipment (UE).

Antenna array structure 110 includes first and second beam forming antenna arrays, namely a dual polarity central scan angle (CSA) array 106 and a wide scan angle (WSA) array 108, that are co-located on a common planar array reflector 112. The antenna array structure 110 is an active electronically scanned array having a beam peak direction 119 that can be adjusted relative to an antenna propagation axis 121 (also known as the antenna boresight) that is normal to the array reflector 112. With reference to the three dimensional orthogonal X-Y-Z reference coordinates shown in FIG. 1 and FIG. 2, the planar array reflector 112 extends in the X-Y plane and the antenna propagation axis 121 extends parallel to the Z axis in a direction that is normal to the X-Y plane. As best shown in FIG. 2, in the illustrated example, the antenna array structure 110 the beam peak direction 119 can be described with two angles, namely angle θ, which is the angle of the beam peak direction 119 from the antenna propagation axis 121, and angle φ, which represents the rotation of the the beam peak direction 119 around the antenna propagation axis 121. In the illustrated example, the angle φ denotes the angle of the beam peak direction 119 from the X-Z plane that is intersected by the antenna propagation axis 121, and in the particular example illustrated in FIG. 2, the angle φ=0. In a use case where the antenna array structure 110 is mounted with X-Z plane in a horizontal direction, the angles φ and θ can describe a direction of beam peak 119 that corresponds to what is commonly referred to as downtilt.

In example embodiments, the combination of CSA array 106 and WSA array 108 enables the propagation angle θ of the beam peak direction to be scanned within a total scan angle range 140 of $+/-\theta_W$ relative to an antenna propagation axis 121. In some example embodiments, $\theta_W$=70°, however other angles are also possible. For example, the maximum scan angle $\theta_W$ may be more than 70° (for example 75°) or less than 70° in some embodiments. In at least some example embodiments, the CSA array 106 and WSA array 108 can each be steered to enable downtilt angle φ to be steered away from φ=0, for example +/−40°.

In example embodiments, the planar array reflector 112 is formed from a conductive material that provides structural rigidity to the antenna array structure 110. In one example, the reflector 112 is formed from aluminum. In some example embodiments, isolated RF feed ports are provided on a back surface of the planar array reflector 112 to connect each of the antenna elements in CSA array 106 and WSA array 108 to a respective RF feed line. In alternative embodiments, the reflector could for example be a multilayer printed circuit board (PCB) that includes a conductive ground plane layer with a ground connection, one or more dielectric substrate layers, and one or more layers of conductive traces for distributing one or both of control and RF signals throughout the planar array reflector 112.

The CSA array 106 is a rectangular two-dimensional R by M periodic array made up of a plurality of rows 116 of dual polarity antenna units 120 (R=4, M=5 in the illustrated example) secured to the planar array reflector 112. In an example embodiment, each dual polarity antenna unit 120 includes a pair of co-located dipole antenna elements 122, 124, that have orthogonal polarization axes. Thus, CSA array 106 is made up of two arrays of dipole antenna elements 122, 124. In the illustrated example, each dipole antenna element 122 has a +45° polarization in the X-Y plane and each dipole antenna element 124 has a −45° polarization in the X-Y plane. In example embodiments, the periodic spacing in both the X and Y directions between adjacent dual polarity antenna units 120 is S1≈λ/2, where λ is an operating wavelength that corresponds to a frequency within the operating frequency band that the antenna array structure 110 is designed to support. By way of non-limiting example, λ may in one example be a wavelength that corresponds to a frequency within a frequency band of 3.4 GHz to 3.8 GHz. In other example embodiments, array spacing of other than S1≈λ/2 may be used.

Referring to FIG. 2, each of the dipole antenna elements 122, 124, is connected to a respective RF feed line 132. RF feed lines 132 connect the dipole antenna elements 122, 124 through an amplifying and phase shifting module 130 to transmit/receive (Tx/Rx) circuitry 126. When transmitting signals, each dipole antenna element 122, 124 is fed RF signals generated by the transmit/receive (Tx/Rx) circuitry 126 through amplifying and phase shifting module 130 for transmission over a wireless channel. When receiving signals, RF signals received through the wireless channel at each dipole antenna element 122, 124 are sent through amplifying and phase shifting module 130 to transmit/receive (Tx/Rx) circuitry 126. Amplifying and phase shifting module 130 is configured to apply antenna element excitation weights to enable a magnitude and phase of the RF signal applied to or received from each of the dipole antenna elements 122, 124 to be individually controlled by a controller 128.

During operation, the phase and amplitude of the RF signals applied to or received from each of the dipole antenna elements 122, 124 of the dual polarity antenna units 120 can be independently adjusted by controller 128 to collectively control the propagation angle θ of the CSA array 106 in two dimensions (e.g. in the Y-Z plane and the X-Z plane) relative to antenna propagation axis 121. In example embodiments, a number of different types of known dual polarity antenna designs can be used for the dual polarity antenna units 120 of CSA array 106, which conventionally have a scan angle range of +/−(30° to 40°) relative to the antenna propagation axis 121. Thus, in example embodiments, the CSA array 106 has a first, central scan angle range 134 of $+/-\theta_C$ relative to the antenna propagation axis 121. In some example embodiments, $\theta_C$=40° such that the effective scan angle range 134 of the CSA array 106 is +/−40° relative to the antenna propagation axis 121, although the central scan angle range 134 may be greater or less than +/−40° in some embodiments. For example, the effective scan angle range 134 of the CSA array 106 is +/−35° in some embodiments, and the effective scan angle range 134 of the CSA array 106 is +/−30° in some embodiments.

Figure 3:
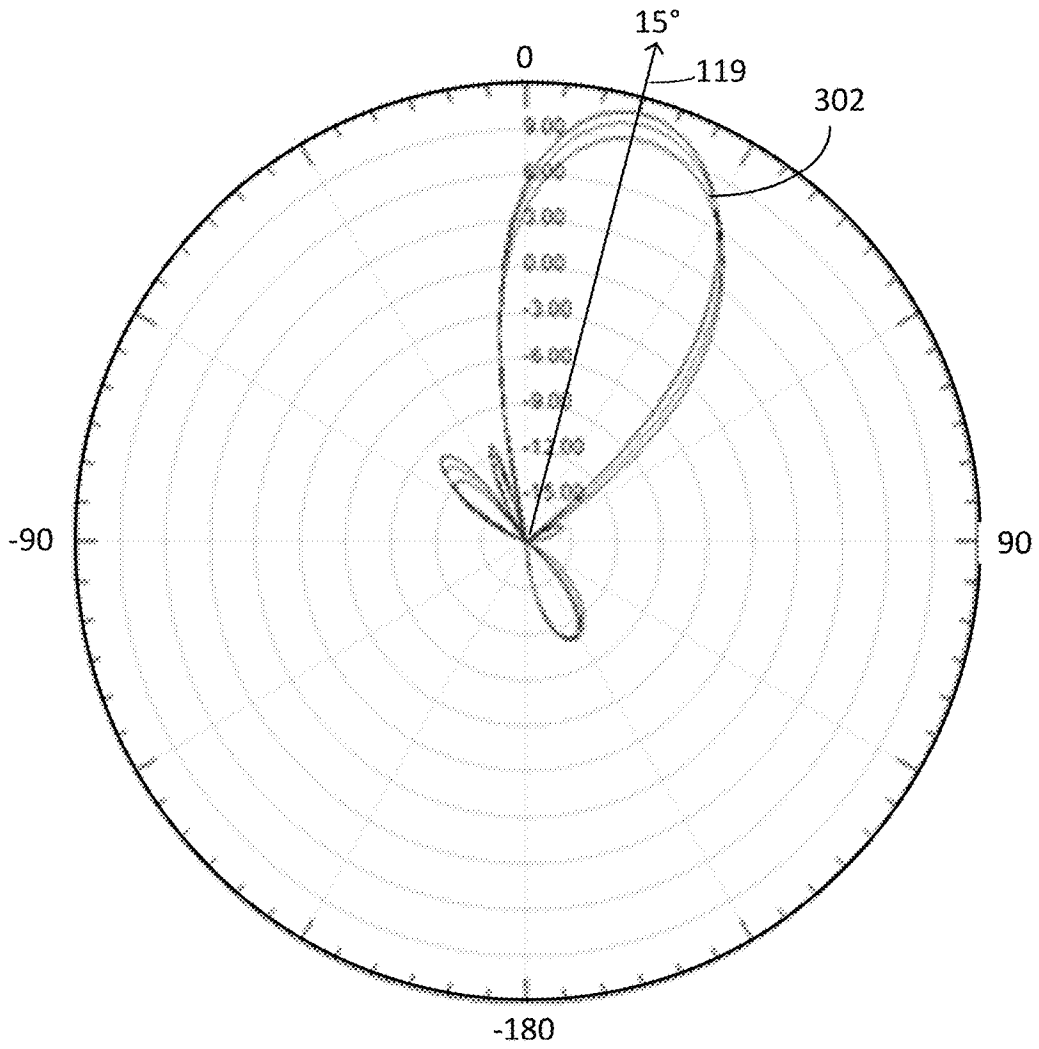
FIG. 3 illustrates a simulated radiation pattern of a row of dipole antenna elements of the antenna array structure of FIG. 1.

For purposes of illustrating operation of CSA array 106, FIG. 3 illustrates a simulated radiation pattern for one row 116 of 5 dipole antenna elements 122 wherein amplifying and phase shifting module 130 applies the following antenna element excitation weights to the RF signal applied to each antenna element 122, from left to right, as follows: $1^{st}$ antenna element 122: magnitude weight (M)=0.5V, phase weight (P)=0°; $2^{nd}$ antenna element 122: M=0.8V, P=−50°; $3^{rd}$ antenna element 122: M=1V, P=−100°; $4^{th}$ antenna element 122: M=0.8V, P=−150°; and $5^{th}$ antenna element 122 M=0.5V, P=−200°. Plots 302 represent three azimuth cuts at 3.4 Ghz, 3.6 GHz and 3.8 GHz. As shown in FIG. 3, the resulting transmitted RF signal has a beam peak 119 at θ=+15°. As shown in FIG. 3, the RF signal pattern has minimal side lobes when the beam peak direction is at 15°. Simulation results show that the side lobes grow when the beam peak 119 approaches the limits of the central scan angle range 134

Referring again to FIG. 1 and FIG. 2, as noted above, antenna array structure 110 also includes WSA array 108 co-located with dual-polarity array 106 on planar array reflector 112. WSA array 108 includes antenna elements that can be controlled to scan wide angle regions that fall outside of the narrower central scan range 134 of the dual-polarity array 106.

In the illustrated example WSA array 108 is a rectangular two-dimensional R+1 by N periodic array made up of a plurality of rows 114 of monopole antenna elements 118(*r*, *c*), where $1 \leq r \leq R+1$ and $1 \leq c \leq N$ (R+1=5, N=9 in the illustrated example of FIG. 1 and FIG. 2) secured to the planar array reflector 112. The monopole antenna elements 118(*r*,*c*) each are polarized in a direction that is approximately normal to the planar array reflector 112 (e.g. parallel to the antenna propagation axis 121). In an example embodiment, rows 114 of monopole antenna elements 118(*r*,*c*) alternate with rows 116 of the dual polarity antenna units 120. Although different array spacing can be used in different embodiments, in the example shown in FIG. 1 and FIG. 2, the periodic spacing in the X direction between adjacent monopole antenna elements 118(*r*,*c*) within each row 114 is $S2 \approx \lambda/4$, and the periodic spacing in the Y direction between adjacent monopole antenna elements 118(*r*,*c*) within each column is $S1 \approx \lambda/2$.

As with dipole antenna elements 122, 124, in example embodiments each of the monopole antenna elements 118 (*r*,*c*) is also connected by a respective RF feed line 130 to amplifying and phase shifting module 130, which in turn is connected to transmit/receive (Tx/Rx) circuitry 126. Amplifying and phase shifting module 130 is configured to enable an amplitude and phase of the RF signal applied to or received from each of the monopole antenna elements 118(*r*,*c*) to be individually controlled by controller 128.

During operation, the phase and amplitude of the RF signals applied to or received from each of the monopole antenna elements 118(*r*,*c*) is controlled by controller 128 to achieve a desired propagation angle $\theta_{UE}$ for the beam peak direction 119 relative to antenna propagation axis 121. In example embodiments, the desired propagation angle corresponds to an optimal angle for a particular UE that the antenna array structure 110 is exchanging the subject RF signals with, referred to hereafter as the UE propagation angle.

A number of different types of known monopole antenna designs can be used for monopole antenna elements 118(*r*,*c*) of the WSA array 108. Monopole antenna elements 118(*r*,*c*) have a polarization that is normal to the planar array reflector 112 and orthogonal to the polarizations in the X-Y plane of dipole antenna elements 122, 124. Accordingly, the monopole antenna elements 118(*r*,*c*) are not be particularly effective for radiating RF signals within the central scan angle range 134 covered by CSA array 106, however they are effective for radiating RF signals within the wider scan angle ranges 138 and 136 that border the central scan angle range 134. In example embodiments monopole antenna elements 118(*r*,*c*) can be controlled by controller 128 to provide a wide angle scan range 136 of between approximately $+\theta_C$ to $+\theta_w$, and a wide angle scan range 138 of between approximately $-\theta_C$ to $-\theta_w$, relative to the antenna propagation axis 121. Thus, in example embodiments, the WSA array 108 and the CSA array 106 collectively provide a total scan angle range 140 of $+/-\theta_W$ relative to the antenna propagation axis 121. In one example, $\theta_C$=40° and $\theta_W$=70°, such that the combination of WSA array 108 and dual-polarity array 106 provide the antenna array structure 110 with a larger overall scan angle range than each of the individual arrays, for example a continuous scan angle range of +/−70°. As noted above, in some examples the continuous scan angle range can be more or less than +/−70°, including for example +/−75°.

Figure 4:
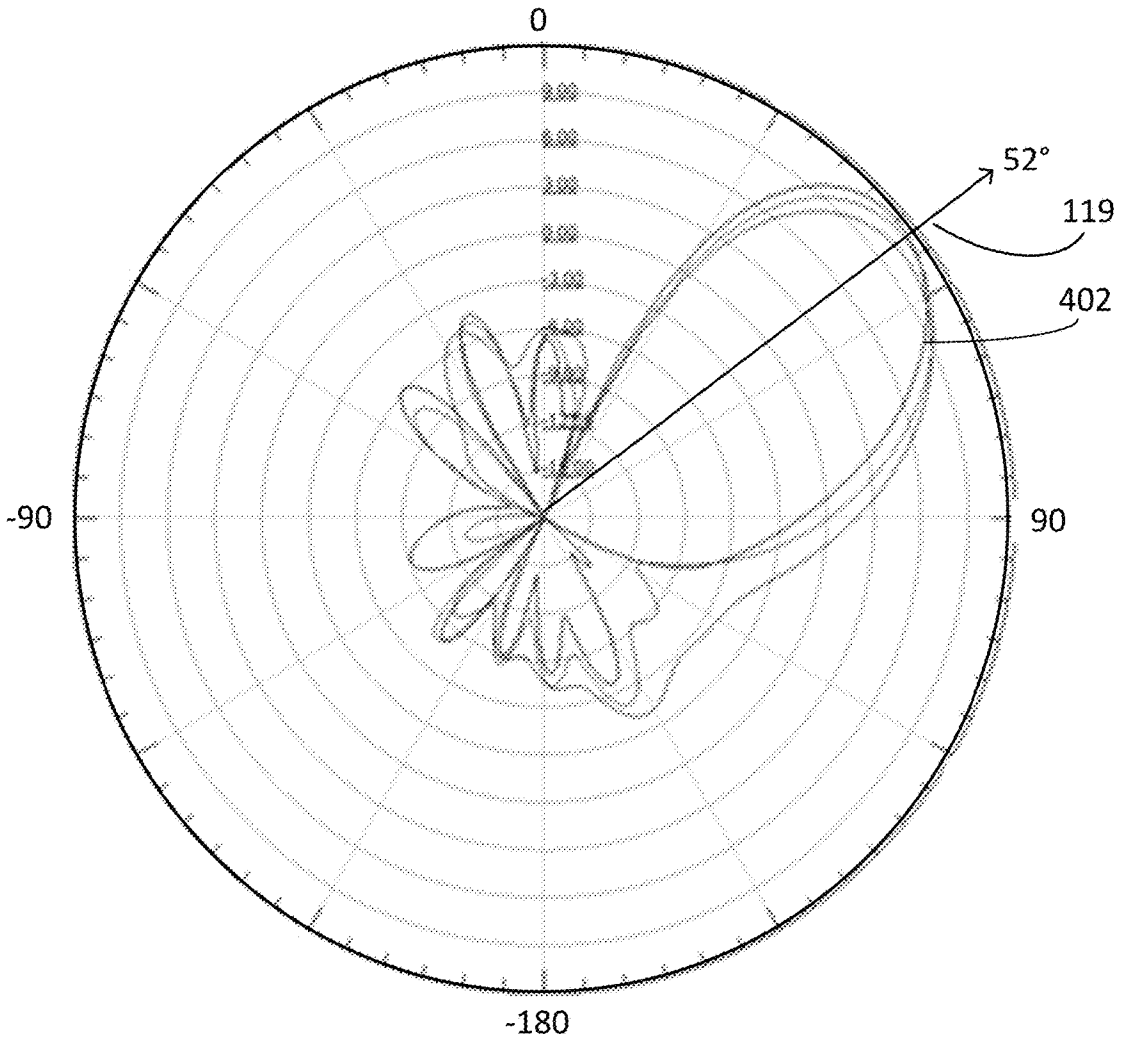
FIG. 4 illustrates a simulated radiation pattern of a row of monopole antenna elements of the antenna array structure of FIG. 1.

For purposes of illustrating operation of WSA array 108, FIG. 4 illustrates a simulated radiation pattern for one row 114 of 9 monopole antenna elements 118(*r*,1) to 118(*r*,9) for an example where controller 128 specifies a UE propagation angle $\theta_{UE}$=52°. In the example illustrated in FIG. 4, amplifying and phase shifting module 130 applies the following antenna excitation weights to the RF signal applied to each of the monopole antenna elements 118(*r*,1) to 118(*r*,9), from left to right in a single row 114, as shown in the following table:

TABLE 1

WSA Antenna Control Factors

| Antenna Element | Excitation Magnitude (V) | Excitation Phase (°) |
|---|---|---|
| 118(r, 1) | $(Dtaper)^4$ | 0 |
| 118(r, 2) | $(Dtaper)^3$ | Dphase |
| 118(r, 3) | $(Dtaper)^2$ | 2 * (Dphase) |
| 118(r, 4) | Dtaper | 3 * (Dphase) |
| 118(r, 5) | 1 | 4 * (Dphase) |
| 118(r, 6) | Dtaper | 5 * (Dphase) |
| 118(r, 7) | $(Dtaper)^2$ | 6 * (Dphase) |
| 118(r, 8) | $(Dtaper)^3$ | 7 * (Dphase) |
| 118(r, 9) | $(Dtaper)^4$ | 8 * (Dphase) |

For the UE propagation angle $\theta_{UE}$=52° of FIG. 4, dphase=63° and dtaper=0.8. Plots 402 represent three azimuth cuts at 3.4 Ghz, 3.6 GHz and 3.8 GHz. As shown in FIG. 4, the resulting transmitted RF signal has a beam peak direction 119 at +52°. Different dphase and dtaper values can be used to achieve different UE propagation angles; for example, simulation results for dphase=95° and dtaper=0.7 resulted in a beam peak at 70° and simulation results for dphase=80° and dtaper=0.8 resulted in a beam peak at 62°.

Figure 5A:
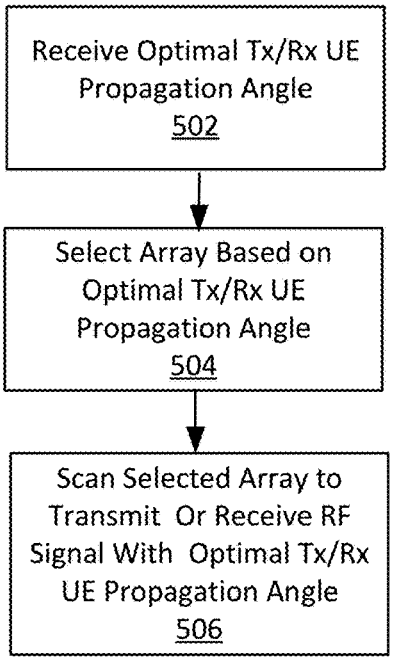
FIG. 5A is a flow diagram of an example method of transmitting an RF signal using the antenna array structure of FIG. 1.

FIG. 5A shows an example method for transmitting or receiving an RF signal from antenna array structure 110. In example embodiments, antenna array structure 110 is used to transmit and/or receive RF signals using time division duplexing (TDD) in a multiple input multiple output (MIMO) environment. For example antenna array structure 110 may be part of a base station that communicates with multiple UEs. Based on predetermined information, a scheduler at the base station determines a time slot to to transmit or receive an RF signal to or from a particular UE. Based on tracked information about the channel between the base station and the UE, the scheduler or the base station determines an optimal angle (the UE propagation angle $\theta_{UE}$) to use for the RF signal. The UE propagation angle $\theta_{UE}$ will fall within the total scan angle range 140 of the antenna array structure 110 (E.g. within $+/-\theta_w$). In the example of FIG. 5A, controller 128 receives the UE propagation angle $\theta_{UE}$ that is to be used for a transmitting or receiving the RF signal (block 502). The controller 128 then selects which antenna array should be used to transmit or receive the RF signal based on the UE propagation angle (block 504). In particular, if the UE propagation angle θUE falls with the central scan angle range 134 (e.g. $|\theta_{UE}|<|\theta_c|$) then the controller 128 will select the CSA array 106. However, if the UE propagation angle $\theta_{UE}$ falls outside of the central scan angle range 134 but within the wider scan angle ranges 136, 138, (e.g. $|\theta_{UE}|>|\theta_c|$ and $|\theta_{UE}| \leq |\theta_w|$) then the controller 128 will select the WSA CSA array 106.

The controller 128 then causes the appropriate amplitude and phase weights to be applied to the RF signals that are provided to each of the respective antenna elements of the selected antenna array to achieve the UE propagation angle $\theta_{UE}$ for the RF signal (block 506). In particular, in cases where the UE propagation angle $\theta_{UE}$ falls with the central scan angle range 134, the controller 128 causes the phase and amplitude of the RF signal applied to each of the dipole antenna elements 122, 124 to be individually controlled such that the resulting RF signal transmitted or received by CSA array 106 has a beam peak at approximately the UE propagation angle $\theta_{UE}$. In cases where the UE propagation angle $\theta_{UE}$ falls outside the central scan angle range 134, the controller 128 causes the phase and amplitude of the RF signal applied to each of the monopole antenna elements 118(*r,c*) to be individually controlled such that the resulting RF signal transmitted or received by WSA array 108 has a beam peak at approximately the UE propagation angle $\theta_{UE}$.

Although the example described above have assumed a discrete transition at $+/-\theta_C$ between the central scan angle range 134 of the CSA array 106 and the wide scan angle range 136,138 of the WSA array 108, in at least some example embodiments there can be an overlap between the central scan angle range 134 of the CSA array 106 and the wide scan angle range 136,138 of the WSA array 108. In such an example, in block 504 the controller 128 may select both the CSA array 106 and the WSA array 108, and cause both the CSA array 106 and the WSA array 108 to simultaneously transmit (or receive) the RF signal in block 506. By way of non-limiting example, the overlap region may be $+/-(\theta_C+/-5°)$, such that when $|\theta_c-5°|\leq|\theta_{UE}|\leq\theta_c+5°|$, both CSA array 106 and the WSA array 108 are used to transmit the RF signal in a scheduled time slot with appropriate phase and amplitude adjustment factors being individually applied to the RF signals for each of the dipole antenna elements 122, 124 and monopole antenna elements 118(*r,c*) to collectively achieve the UE propagation angle $\theta_{UE}$. In some example embodiments, the overlap region overlap may be similar to what is found in overlap between cell site coverage 'sectors' in cellular networks, primarily to avoid dropped connections in these areas of transition between sectors.

In summary, in example embodiments the antenna array structure 110 includes three independent arrays co-located on planar array reflector 112. In particular, CSA array 106 includes two arrays, namely a first array of dipole antenna elements 122 and a second array of dipole antenna elements 124. The dipole antenna elements 122 and dipole elements 124 are each polarized parallel to the planar array reflector 112 and orthogonal to each other. A third array is provided by WSA array 108 whose monopole antenna elements 118(*r,c*) are each polarized orthogonal to the dipole antenna elements 122, 124. The two orthogonal arrays of the CSA array 106 are capable of forming beams within a central scan angle range of an axis 121 that is normal to planar array reflector 112, and the WSA array 108 is capable of forming beams at angle that fall outside of central scan angle range.

In at least some example embodiments the use of an planar antenna array structure 110 having co-located CSA array 106 and WSA array 108 provides a structure that can effectively form beams over a greater range of propagation angles than many conventional planar arrays. Furthermore, in a conventional array a high antenna element density may be required to reduce unwanted sidelobes wide beam steering angles. In the case of antenna array structure 110, an increase in gain can result from an overlap in the WSA array individual antenna element pattern and the CSA array individual element pattern, permitting the pattern beam widths for the individual antenna elements to be somewhat reduced compared to a conventional 65 degree cellular antenna. As will be described in further detail below, WSA array individual element pattern gain can be further increased when a configurable antenna element is used.

Accordingly, in some example embodiments the antenna elements of the CSA array 106 and WSA array 108 may be configured to have reduced antenna element radiation beamwidth, and higher gain. This can allow for the reduction of the overall array size. Reduced array size can be an important factor in the context of lower frequencies which have larger bandwidth and hence require larger antenna elements.

Figure 5B:
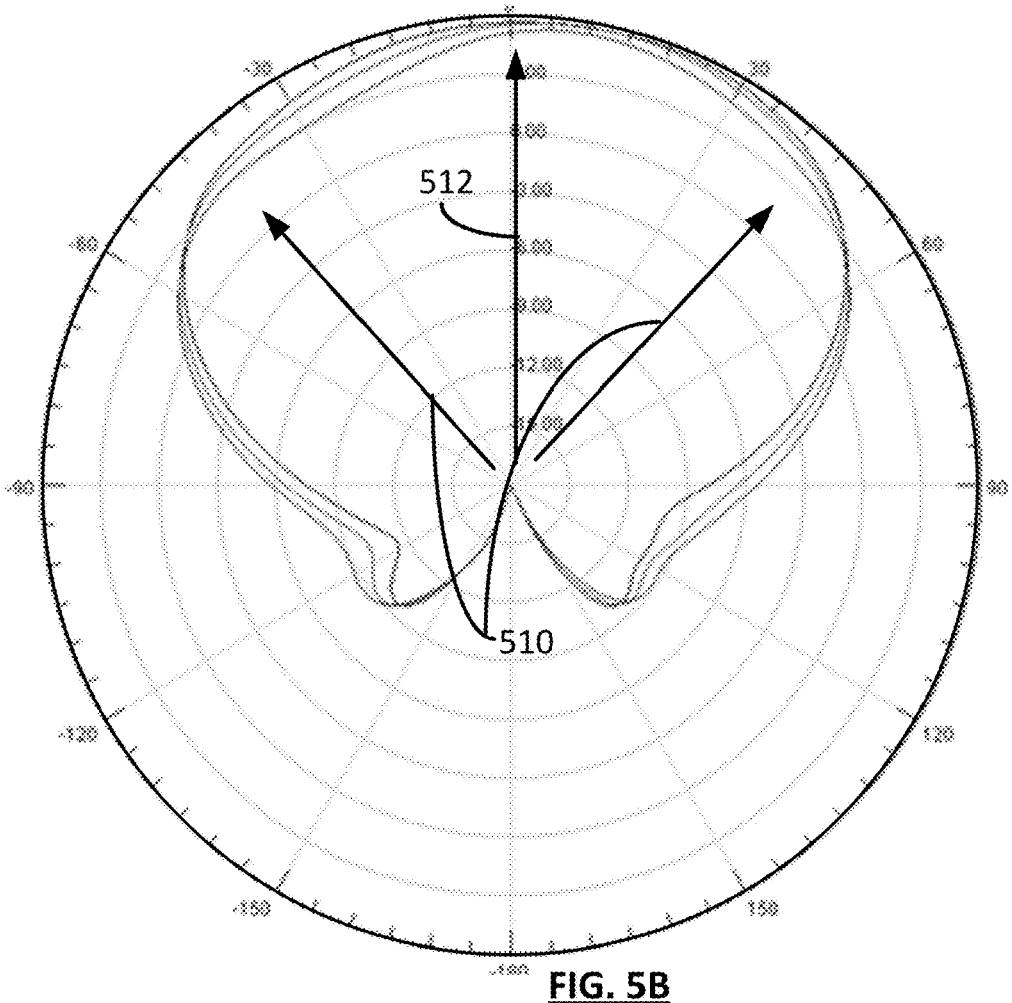
FIG. 5B illustrates a possible radiation pattern of a single antenna element of the central scan array of the antenna array structure of FIG. 1.

In this regard, FIG. 5B is a plot of one antenna element of the CSA, and its 3 dB beamwidth approximately represents the scan angle range of CSA array 106. Lines 510 represent regions where the coverage patterns of the WSA array 108 overlaps with that of the CSA array 106, and line 512 represents the normal (boresight) boresight axis of the CSA array 106. The combination of WSA array 108 with CSA array 106 allows the gain of the CSA array 106 to be reduced in the areas that can be covered by the WSA array 108. For example, the CSA array 106 may be implemented using antenna elements that have a scan angle range of <65°, but which have a greater beam focus and gain near the boresight axis of 0°. This can allow a reduction in the number of rows or columns of antenna units 120 required for the CSA array 106 in the absence of WSA array 108.

In the WSA array 108 described above, the monopole antenna elements 118(*r,c*) have an X-axis spacing of S2≈λ/4 and a Y-axis spacing of S1≈λ/2, and the propagation angle θ of the WSA array 108 relative to antenna propagation axis 121 may be controlled to a greater extent in the Z-X plane than the Z-Y plane. In other example embodiments, the monopole antenna elements 118(*r,c*) are arranged to also allow the propagation angle θ of the WSA array 108 to be controlled to a similar degree in both the Z-Y-plane and the Z-X plane, allowing improved two dimensional control of the propagation angle θ relative to antenna propagation axis 121.

Figure 6:
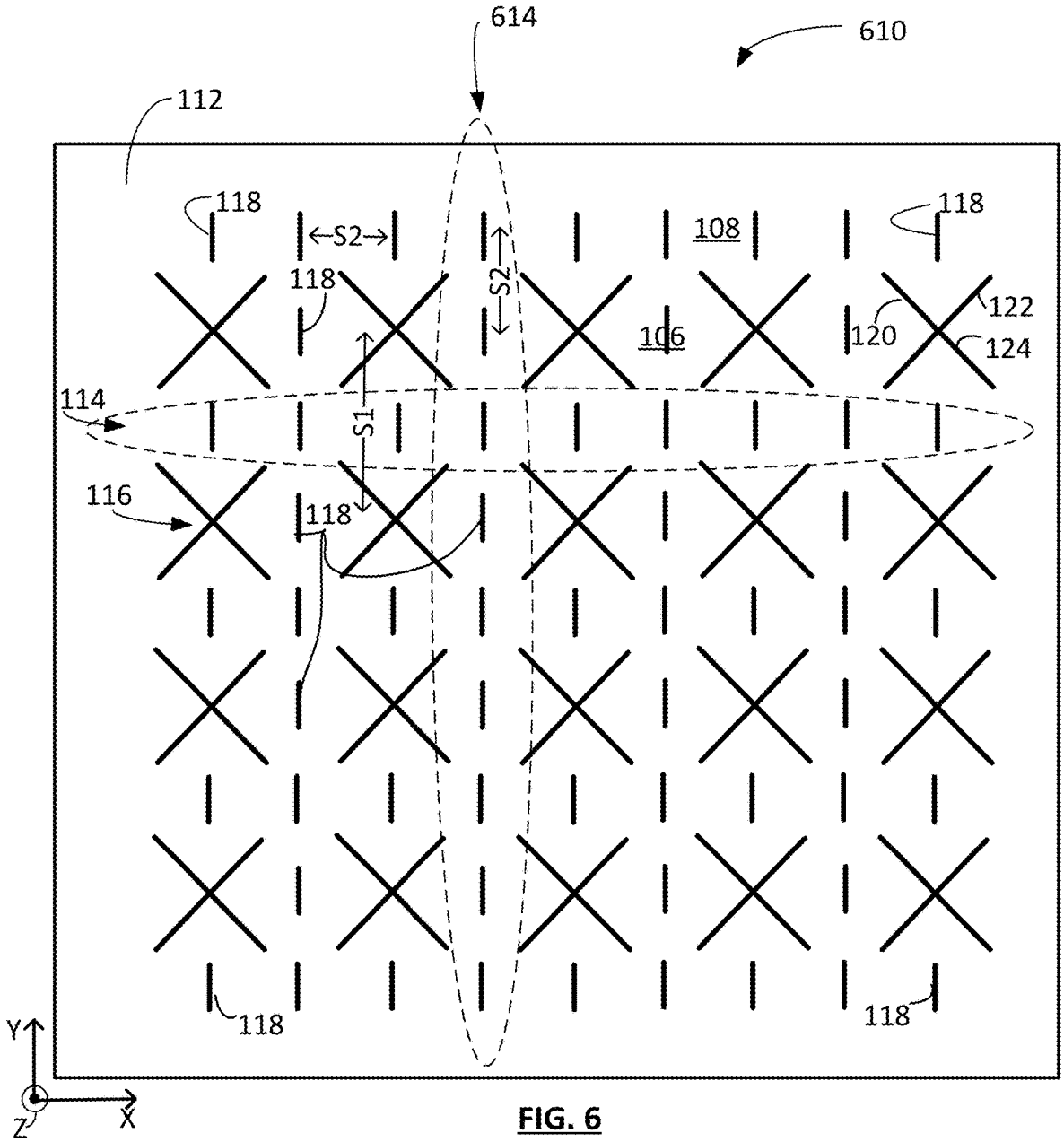
FIG. 6 is a front view of an antenna array structure according to a further example embodiment.

In this regard, FIG. 6 illustrates a further antenna array structure 610 that is identical to antenna array structure 110 described above except for differences in the WSA array 108 that will now be described. Antenna array structure 610 includes additional monopole antenna elements 118 between the dual polarity antenna units 120 in each row 116 such that alternating columns 614 of the WSA array 108 have an inter-monopole antenna element spacing of S2≈λ/4. In this regard, as seen in FIG. 6, the $2^{nd}$, $4^{th}$, $6^{th}$ and $8^{th}$ columns 614 of WSA array 108 each include 9 monopole antenna elements 118 that have a Y-axis spacing of S2≈λ/4 between adjacent elements, while the $1^{st}$, $3^{rd}$, $5^{th}$, $7^{th}$ and $9^{th}$ columns of WSA array 108 each include 5 monopole antenna elements 118 that have a Y-axis spacing of S1≈λ/2 between adjacent elements.

Similarly, the $1^{st}$, $3^{rd}$, $5^{th}$, $7^{th}$ and $9^{th}$ rows 114 of WSA array 108 each include 9 monopole antenna elements 118 that have an X-axis spacing of S2≈λ/4 between adjacent elements, and the $2^{nd}$, $4^{th}$, $6^{th}$ and $8^{th}$ rows of WSA array 108 each include 4 monopole antenna elements 118 that have an X-axis spacing of S1≈λ/2.

The combination of columns 614 of monopole antenna elements 118 with Y-axis spacing of S2≈λ/4 and rows 114 of monopole antenna elements 118 with Y-axis spacing of S2≈λ/4 enables the WSA array 108 to scan wide angles $\theta_C$ to $\theta_W$ in both the Z-Y plane and the Z-X plane, allowing two dimensional control of wide angle beam forming relative to the antenna propagation axis 121.

In the example embodiments described above, the CSA array 106 that covers the central scan angle range $+/-\theta_C$ comprises two arrays of co-located, orthogonally polarized dipole antenna elements 122, 124. In other example embodiments, different types of antenna elements can be used in place of dipole antenna elements 122, 124, so long as they are polarized approximately parallel to the plane of the planar array structure 112 (e.g. in the X-Y plane). For example, other types of single polarized antenna elements that could be used for the CSA array 106 include: slot antenna elements, slot coupled patch antenna elements, probe fed patch antenna elements, right hand or left hand circular polarized antenna elements, or any suitable single linear polarized antenna element.

In the example embodiments described above, the WSA array 108 is made up of monopole antenna elements that are polarized approximately normal to the plane of the planar array structure 112 (e.g. in the Z-axis). Different types of antenna elements can to implement the WSA array 108, so long as they are polarized approximately normal to the plane of the planar array structure 112. Examples of other possible antenna elements include configurable monopole antenna elements with parasitic switchable features, folded monopole antenna elements, and, in particular example embodiments, a configurable reversible inverted F-antenna (IFA) element.

Figure 7:
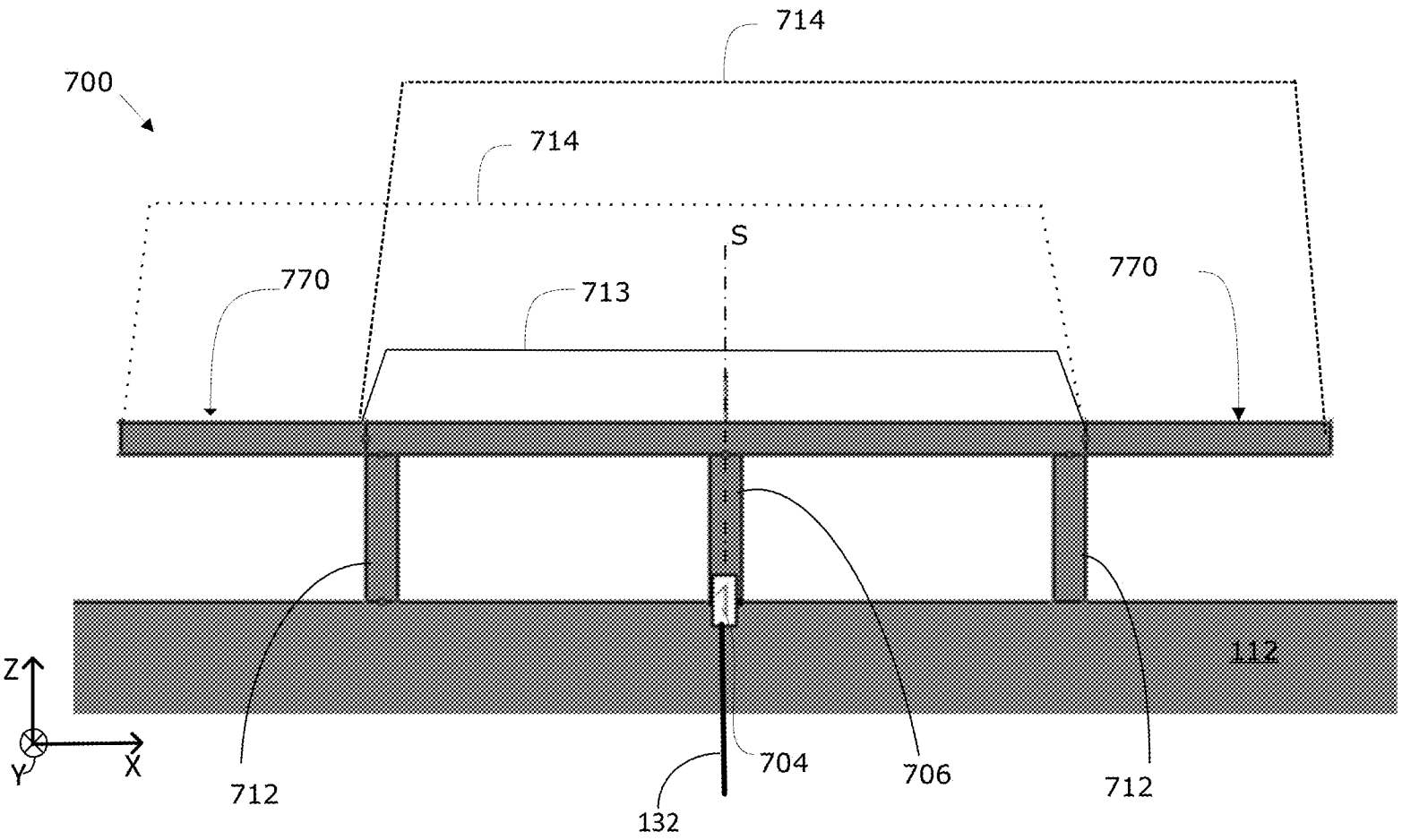
FIG. 7 is a side diagrammatic view of an example configurable antenna unit according to an example embodiment.
Figure 8:
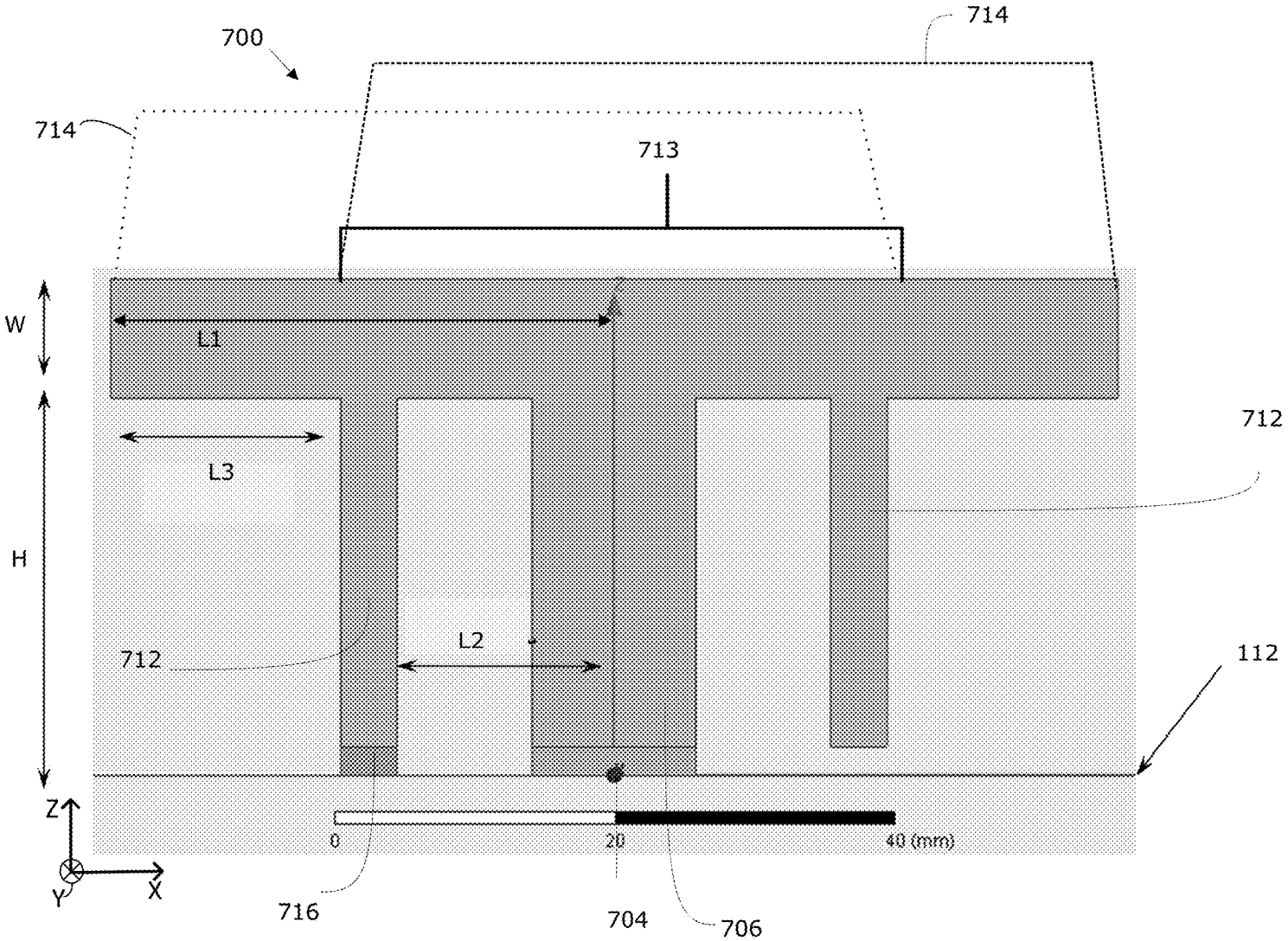
FIG. 8 is a further side diagrammatic view of the example configurable antenna unit of FIG. 7, showing example dimensions.

In this regard, FIGS. 7 and 8 illustrate diagrammatic views of an example of a configurable reversible IFA (RIFA) unit 700 that may be used to implement the monopole antenna elements 118(*r,c*) and 118 in the antenna array structures 110, 610 described above. The antenna unit 700 is shown on common array reflector 112. The antenna unit 700 may be electrically coupled or uncoupled to the ground plane of common array reflector 112. In some example embodiments, the antenna unit 700 may be formed from a conductive material printed or otherwise provided on a surface of a substrate. A first and at least a second IFA antenna element 770 are defined in the antenna unit 700, as explained further below.

The antenna unit 700 is electrically coupled to an RF signal port 704 via a feed portion 706. RF signal port 704 is connected to a respective RF line 132. The longitudinal axis of the feed portion 706 defines an axis of symmetry (indicated by dotted line S in FIG. 7) of the antenna unit 700. The antenna unit 700 includes a plurality of selective grounding portions 712; the example in FIG. 7 shows first and second selective grounding portions 712. Each selective grounding portion 712 is configured so that the selective grounding portion 712 can enable or disable an electrical coupling to the ground plane. For example, FIG. 8 shows a switchable element 716 (e.g., a switchable PIN diode) at the end of the selective grounding portion 712, to selectively enable or disable an electrical coupling, for example to the ground plane. In some example embodiments, the switchable element 716 may be a tunable element which can be variably tuned by controller 128. For example, in some embodiments, the switchable element 716 may be tuned to function as an electrical short or a non-zero impedance, or may include a tuning or varactor diode.

The antenna unit 700 also includes a plurality of conductive arms 714; the example in FIG. 7 shows first and second conductive arms 714. The number of conductive arms 714 corresponds to the number of selective grounding portions 712. Each conductive arm 714 provides electrical conduction between the feed portion 706 and a respective one selective grounding portion 712, and extends from the respective one selective grounding portion 712 towards the feed portion 706 and beyond the feed portion 706. It should be noted that the conductive arms 714 may not be distinct from each other. For example, the conductive arms 714 may overlap with each other, such that the conductive arms 714 have an overlapping common portion 713. Such a configuration will be discussed in detail further below.

In the example shown, the conductive arms 714 may be formed integrally with the feed portion 706 and the selective grounding portions 712. Thus, although described as different portions of the antenna unit 700, the feed portion 706, selective grounding portions 712 and conductive arms 714 may not be distinct or physically separate portions of the antenna unit. Conceptually, the antenna unit 700 shown in FIG. 7 may also be thought of as having one arm that provides electrical conduction between the feed portion 706 and both selective grounding portions 712, and extending from both selective grounding portions 712. For ease of understanding, the present disclosure will refer to the antenna unit 700 as having a plurality of conductive arms 714 with respective lengths as indicated, and with each conductively arm 714 corresponding to a respective plurality of selective grounding portions 712.

Figure 9:
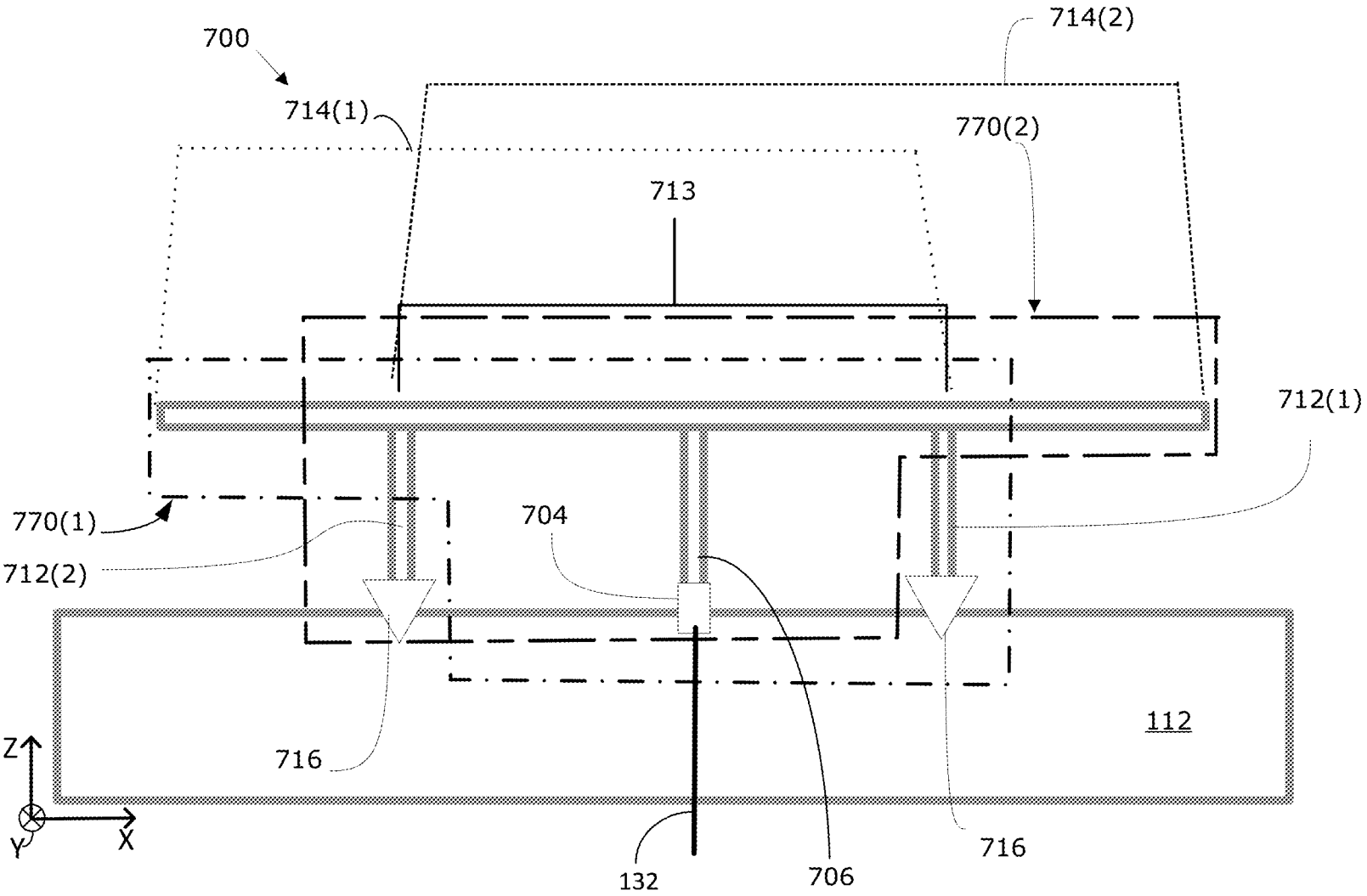
FIG. 9 is a side diagrammatic view of another example configurable antenna unit according to the present disclosure.

The feed portion 706, together with one conductive arm 714, and the respective selective grounding portion 712, define one IFA element 770 of the antenna unit 700. As noted above, the conductive arm 714 of the IFA element 770 is considered to be the conductive portion of the antenna unit 700 that extends from the grounding portion 712 of that IFA element 770 towards the feed portion 706 and extending beyond the feed portion 706, explained further below. The feed portion 706 is common to all IFA elements 770, such that the IFA elements 770 are not discrete elements of the antenna unit 700. For example, as shown in FIG. 9, the feed portion 706, first selective grounding portion 712(1), and first conductive arm 714(1), together define a first IFA element 770(1); the feed portion 706, second selective grounding portion 712(2), and second conductive arm 714(2), together define a second IFA element 770(2). The elements included in IFA elements 770(1) and 770(2) are conceptually indicated by respective dashed boxes. Thus, as can be seen in FIG. 9, the first IFA element 770(1) and second IFA element 770(2) include respective first and second conductive arms 714(1), 714(2) that extend from the corresponding first and second selective grounding portions 712(1), 712(2) towards and extending beyond the common feed portion 706. As shown in FIG. 9, the conductive arms 714(1) and 714(2) may overlap at least partially over a common portion 713 of their length. In some embodiments, common portion 713 can be an integral conductive portion of the RF antenna unit 700 that is common to the first and second conductive arms 714(1) and 714(2). Thus, conceptually, IFA elements 770(1) and 770(2) can be seen to overlap at least partially, in addition to sharing the common feed portion 706.

Notably, in some embodiments the feed portion 706, and the common portion 713, are common to both the first IFA element 770(1) and the second IFA element 770(2). Thus, although the antenna unit 700 is considered to define first and second IFA elements 770(1), 770(2), the first and second IFA elements 770(1), 770(2) are not discrete elements of the antenna unit 700. It should be noted that, in some embodiment, there may not be an overlapping common portion 713 (e.g., the conductive arms 714(1), 714(2) may not be collinear and hence may not overlap), however the feed portion 706 remains common to the first and second IFA elements 770(1), 770(2) in all embodiments.

In some example embodiments, the antenna unit 700 has two IFA elements 770, for example as shown in the examples of FIGS. 7-11. In other examples, the antenna unit 700 has more than two IFA elements 770, for example four IFA elements 770. Other numbers of IFA elements 770 may be defined in the antenna unit 700. Regardless of number, the IFA elements 770 may be arranged symmetrically about the axis of symmetry defined by the feed portion 706. Such an arrangement may be useful in order to achieve a more symmetric radiation pattern for the antenna unit 700. In the case where the antenna unit 700 has two IFA elements 770, the two IFA elements 770 may be arranged with respective conductive arms 714 extending away from and opposite to each other, with both conductive arms 714 polarized normal to the array reflector 112. In example embodiments, the IFA elements 770 may be arranged asymmetrically about the axis defined by the feed portion 706. For example, in the case where the antenna unit 700 has two IFA elements 770, IFA elements 770 may be arranged in a rotation angle other than 180° relative to each other. For example, the IFA elements 770 may be arranged at 90° relative to each other. In the case where the antenna unit 700 has four IFA elements 770, the four IFA elements 770 may be arranged with a separation of 90° between adjacent IFA elements 770, if arranged symmetrically; or at some other angle of separation, if asymmetrically.

Each selective grounding portion 712 may be selectively coupled to the substrate 702 via a respective switchable element 716. Generally, the switchable element 716 may be any suitable element that can selectively enable or disable an electrical coupling with the substrate 702, for example by creating a virtual, RF open circuit or closed circuit. As shown in the example of FIG. 9, the switchable element 716 may be a DC switching PIN diode or other PIN diodes known in the art. The PIN diode can be biased either on or off (e.g., via a control signal from a processor of a wireless communication device in which the antenna unit 700 is implemented) to selectively enable or disable the electrical coupling to the substrate 702. In some examples, the switchable element 716 may selectively enable or disable an electrical coupling by creating a physical open circuit or closed circuit, such as with the use of microelectromechanical system (MEMS) devices.

Figure 10:
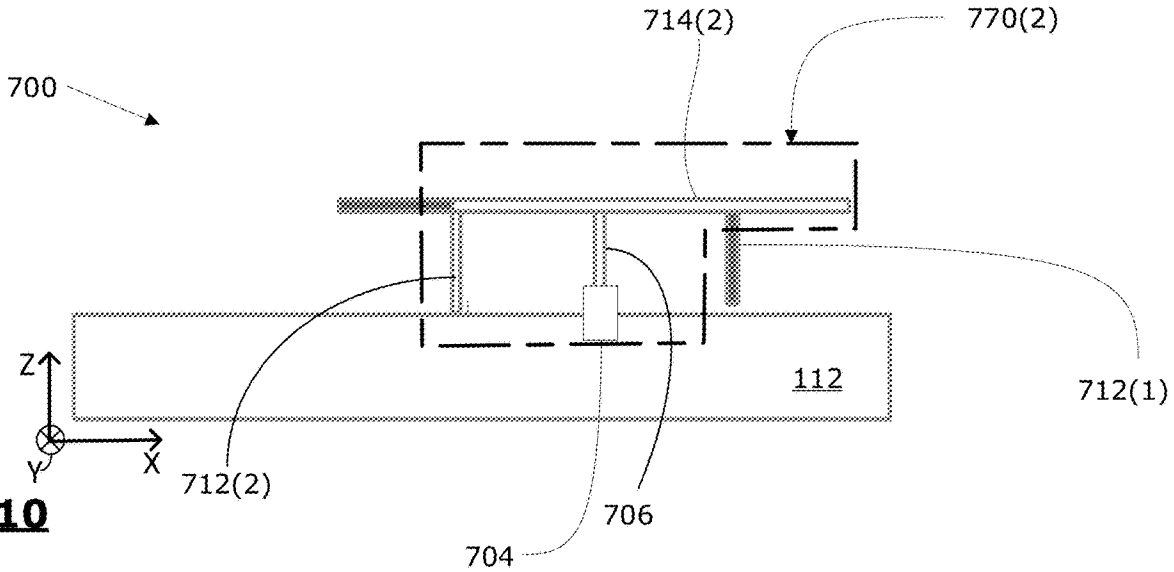
FIG. 10 is a further side diagrammatic view of the example configurable antenna unit of FIG. 7 and illustrates how the example antenna unit of FIG. 7 may be conceptually understood as being formed from multiple superimposed IFA elements.
Figure 11:
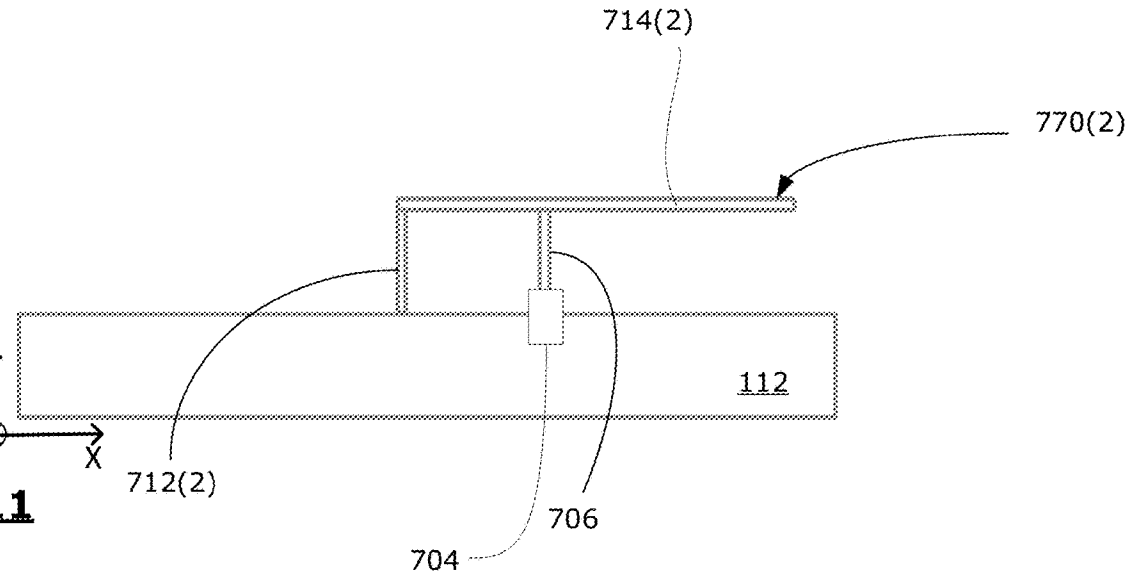
FIG. 11 is a diagrammatic perspective view of the basic antenna unit which is the basis of the example configurable antenna units of FIGS. 7 to 10, according to the present disclosure.

Thus, conceptually as shown in FIGS. 10 and 11, the antenna unit 700 is formed by superimposing and mirroring a plurality of IFA elements 770 about a single RF signal port 704 of the antenna unit 700, with each IFA element 770 being independently controllable to be connected to ground or not by controlling the switchable elements 716. The overlapping nature of the IFA elements 770 results in a more compact design for the antenna unit 700, which may save space and allow more antennas or other components to be installed. Further, no RF switching component is required.

An IFA element 770 whose grounding portion 712 is not electrically coupled to the ground plane of substrate 112 (e.g., whose PIN diode is biased off) may be considered to be inactive and may have reduced or negligible contribution to the overall radiation pattern of the antenna unit 700. Portions of an inactive IFA element 770 may be considered parasitic elements for an active IFA element.

This is conceptually illustrated in FIGS. 10 and 11. For simplicity, the switchable elements 716 are not shown in FIGS. 10 and 11. FIG. 10 shows an antenna unit 700 substantially identical to that shown in FIG. 7 that includes IFA elements 770(1) and 770(2) superimposed and symmetrically located around the feed portion 706. FIG. 10 shows that the electrical coupling between the second selective grounding portion 712(2) and the ground plane of substrate 112 is enabled, and the electrical coupling between the first selective grounding portion 712(1) and the ground plane substrate 112 is disabled. As a result, only the second IFA element 770(2) is active. The second IFA element 770(2) has parasitic artifacts due to portions of inactive IFA element 770(1). The first selective ground portion 712(1) and an extending portion of the first conductive arm 714(1) (both indicated as dark-colored portions) are high impedance open stubs. Specifically, the first selective ground portion 712(1), when not coupled to the ground plane, presents a relatively high impedance parasitic stub to the conductive arm 714(2) of the second IFA element 770(2). Similarly, the first conductive arm 714(1) is shorted by the connection to ground at the second selective grounding portion 712(2), so the extended portion of the first conductive arm 714(1) is an open circuit stub that presents a relatively high impedance parasitic stub to the grounding portion 712(2) of the second IFA element 770(2). The active second IFA element 770(2) is defined by the second conductive arm 714(2), whose length extends from the second selective grounding portion 712(2) towards and beyond the feed portion 706. The active IFA element 770(2), is conceptually illustrated in FIG. 11 (with parasitic elements removed for ease of understanding). It should be noted that the IFA element 770(2) shown in FIG. 11 is substantially identical to a conventional IFA element such as IFA element 15 seen in FIG. 7. Thus, conceptually, the antenna unit 700 shown in FIG. 10 could be formed from multiple superimposed IFA elements 770.

In the example shown in FIG. 10, the antenna unit 700 may have different switched states, defined by different grounding portions 712 being electrically coupled or not electrically coupled to the ground plane (via coupling to the substrate 112), with different radiation patterns being achievable using different switched states, as illustrated in further examples below. In this way, the radiation pattern of the antenna unit 700 can be configurable.

The use of configurable RIFA units 700 for antenna elements 118(*r,c*), 118 of WSA arrays 108 may, in some examples, provide additional main beam gain with a reduced number of array elements. In addition to controlling the amplitude and phase of the RF signal at the feed port 704 of each RIFA unit 700, the controller 128 also controls which of the IFA elements 770(1), 770(2) of each RIFA unit 700 is active by controlling the switchable elements 716. This provides further control of the propagation direction of the individuals RIFA units 700. By way of example, in the example of FIGS. 10 and 11, activating the IFA element 770(2) of a RIFA unit 700 results in a propagation direction in the plus X-axis direction (plus θ), whereas activating the other IFA element 770(1) results in a propagation direction in the minus X-axis direction (minus θ). Including selectable antenna elements in the +/−Y axis direction in RIFA units 700 can further wide angle steering abilities of the WSA array 108.

Figure 12A:
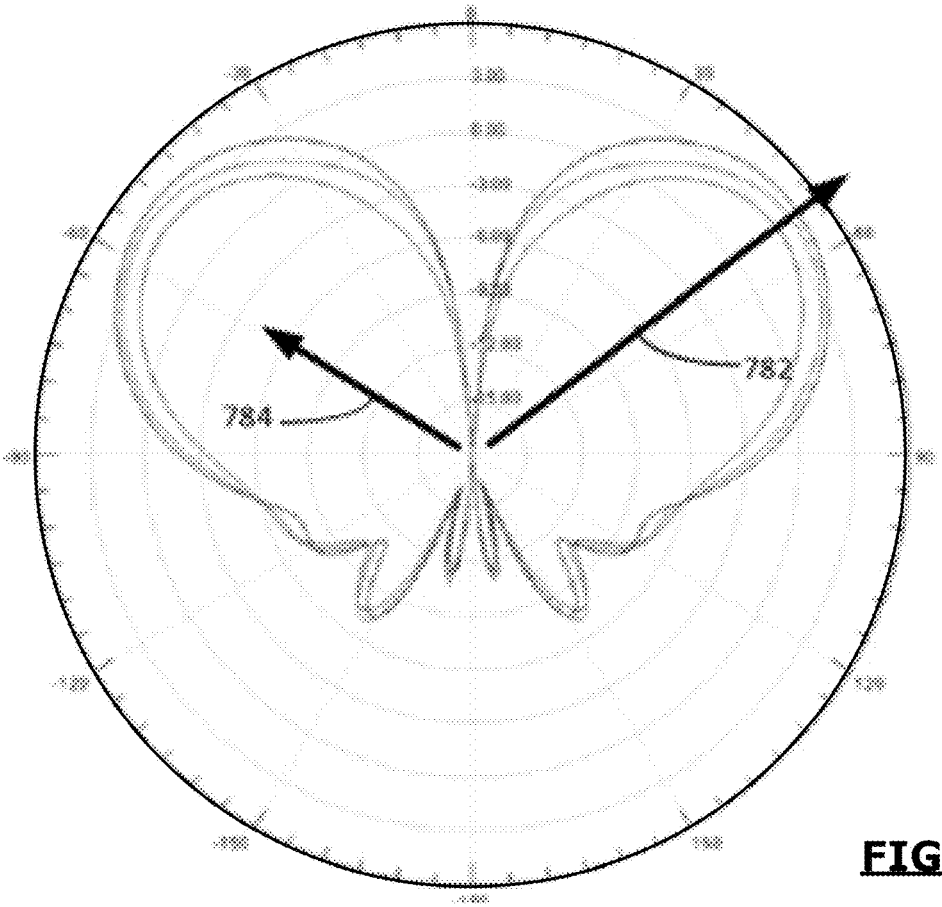
FIG. 12A illustrates a possible radiation pattern of a single antenna element of the wide scan array of the antenna array structure using non-configurable antenna units.
Figure 12B:
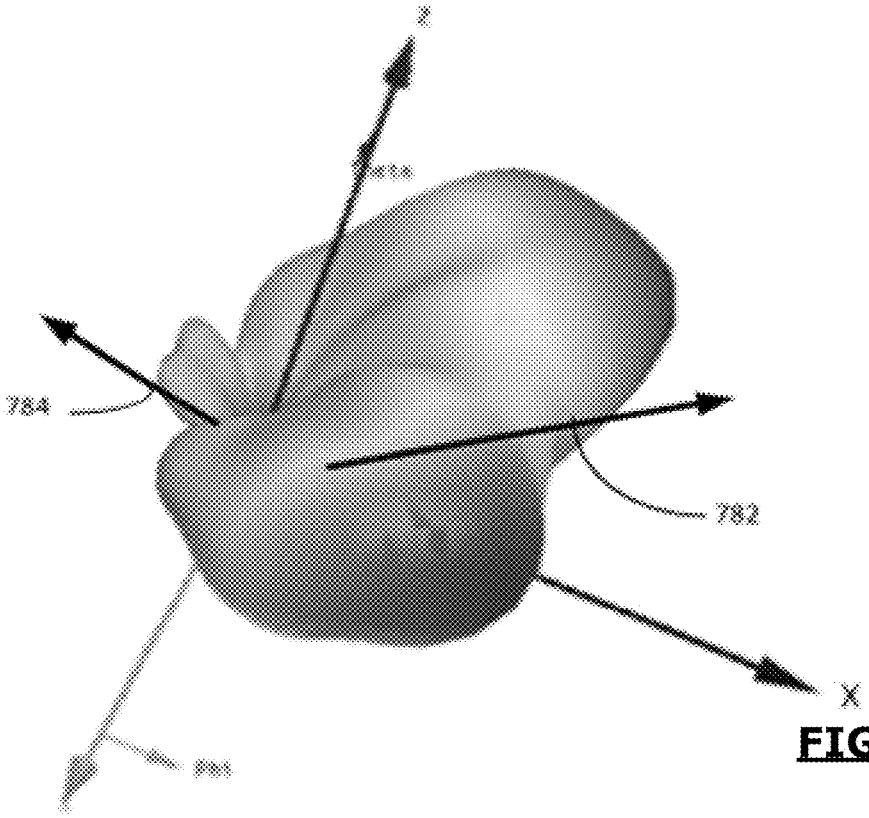
FIG. 12B illustrates a simulated beam pattern of a single antenna element of the wide scan array using configurable antenna units.

In the example of simple monopole antenna elements described above in respect of the embodiments of FIGS. 1 to 6, a maximum antenna element spacing of $S2=\lambda/4$ was required for the antenna elements 118 of WSA array 108. The use of configurable RIFA units 700 for antenna elements 118 of the WSA array 108 can permit the inter-antenna unit spacing to be increased to $\lambda/4$, and the number of columns and/rows of elements to be reduced. By way of illustration, FIG. 12A is a representation of the scan angle range for a WSA array 108 that uses RIFA units 700. Switching between IFA elements 770(1) and 770(2) allows the antenna element gain in a desired main beam direction (illustrated by line 782) to be increased, while the gain in the unwanted direction (illustrated by line 784) can be decreased, thereby decreasing sidelobes. This feature is further illustrated in the 3-D rendering of a simulated signal in FIG. 12B. Pattern gain is formed in main beam direction 782 and decreased in the unwanted beam direction 784, which reduces the gain of unwanted sidelobes that would otherwise have been created in a λ/2 element spacing configuration if simple monopole elements were used. This enables inter-unit spacing S2 to be increased from λ/4 to λ/2 and permits a reduction in the number of antenna elements while keeping the main beam gain the same or higher. Note that the configurable WSA antenna element, such as the RIFA, can also be configured to a complimentary state to that shown in FIG. 12B, with the enhanced gain in the 784 direction and reduced gain in the 782 direction. That state would be used for the case where the WSA main beam is directed towards the direction 784.

Some example dimensions of the antenna unit 700 are now described with reference to FIG. 8. Generally, the antenna unit 700 may be designed with specific dimensions in order to emit or receive wireless RF signals within a desired operating frequency or frequency band. For example, the antenna unit 700 may have at least one IFA element 770 with an operating frequency of 2.4 GHz, or an operating frequency of 5.5 GHz, or any operating frequency within the range of about 700 MHz to 20 GHz or higher, for example about 2.4 GHz to about 5.5 GHz. In some examples, IFA elements 770 designed to operate at different operating frequencies may be used in a singled antenna unit 700 (e.g., in an antenna unit 700 with an asymmetrical configuration). In example embodiments, different antenna units 700 with IFA elements 770 operating at different frequencies may be used together within a single communication device.

In the example of FIG. 8, each IFA element 770 has substantially the same dimensions, and substantially the same operating frequency (e.g., 5 GHz) and antenna characteristics. In this example, the IFA elements 770 are each formed of substantially rectilinear lengths. Each conductive arm 714 may have substantially equal length L1 (e.g., about 0.65 times the operating wavelength λ), substantially equal width W (e.g., about 0.16λ) and at substantially equal spacing H (e.g., about 0.5λ) from the substrate 702. The grounding portions 712 may all be located a distance L2 (e.g., about 0.71λ) from the central axis of symmetry, and the conductive arms 714 may each extend a distance L3 (e.g., about 0.3λ) from each respective grounding portion 712. In the present disclosure, "substantially equal" and "about" can include a range within normal manufacturing tolerances, for example +/−5%. In other example embodiments, the IFA elements 770 may have different dimensions (e.g., having grounding portions 712 at different spacing from the axis of symmetry) and/or have different operating characteristics.

In some example embodiments, the antenna unit 700 may be made from a conductive material such as copper, a copper alloy, aluminum or an aluminum alloy. The antenna unit 700 may be formed as one integral piece.

The disclosed antenna array structures may be useful for one or more of achieving a higher scan angle, as well as smaller array size, including for lower operating frequencies.

The disclosed antenna array structures may be implemented in various applications that use antennas, such as telecommunication applications (e.g., transceiver applications in wireless network base stations or wireless local area network access points). The dimensions described in this application for the various elements of the antenna unit are non-exhaustive examples and many different dimensions can be applied depending on both the intended operating frequency bands and physical packaging constraints.

The present disclosure may be embodied in other specific forms without departing from the subject matter of the claims. The described example embodiments are to be considered in all respects as being only illustrative and not restrictive. Various modifications and combinations of the illustrative embodiments, as well as other embodiments of the invention, will be apparent to persons skilled in the art upon reference to the description. Selected features from one or more of the above-described embodiments may be combined to create alternative embodiments not explicitly described, features suitable for such combinations being understood within the scope of this disclosure.

All values and sub-ranges within disclosed ranges are also disclosed. Also, although the systems, devices and processes disclosed and shown herein may comprise a specific number of elements/components, the systems, devices and assemblies could be modified to include additional or fewer of such elements/components. For example, although any of the elements/components disclosed may be referenced as being singular, the embodiments disclosed herein could be modified to include a plurality of such elements/components. The subject matter described herein intends to cover and embrace all suitable changes in technology. It is therefore intended that the appended claims encompass any such modifications or embodiments.

The invention claimed is:

1. An antenna array structure comprising:

a planar array reflector;

a central beam forming antenna array located on the planar array reflector and configured to form radio frequency (RF) signals having a beam peak that is adjustable within a central scan angle range relative to a propagation axis that is normal to the array reflector; and a wide beam forming antenna array located on the surface of the planar array reflector and configured to form RF signals with a beam peak that is adjustable within a wide angle scan range that at least partially exceeds the central scan angle range, wherein the wide beam forming antenna array includes an array of configurable reversible inverted F-antenna (RIFA) units.

2. The antenna array structure of claim 1 wherein the central beam forming antenna array includes an array of antenna elements that are polarized approximately parallel to the array reflector, and the RIFA units of the wide beam forming antenna array are polarized approximately parallel to the propagation axis and orthogonal to the antenna elements of the central beam forming antenna array.

3. The antenna array structure of claim 2 wherein rows of the antenna elements of the central beam forming antenna array alternate with rows of the RIFA units of the wide beam forming antenna array on the array reflector.

4. The antenna array structure of claim 1 wherein the central beam forming antenna array includes a first array of first antenna elements and a second array of second antenna elements, wherein each first antenna element is co-located with a respective one of the second antenna element, the first antenna elements and second antenna elements having different polarizations.

5. The antenna array structure of claim 4 wherein the first antenna elements and second antenna elements are polarized orthogonally to each other.

6. The antenna array structure of claim 5 wherein the first antenna elements and second antenna elements are each dipole antenna elements.

7. The antenna array structure of claim 1 wherein the central beam forming antenna array includes antenna elements that are polarized parallel to a plane of the array reflector and that are one of: dipole antenna elements; slot antenna elements; slot coupled patch antenna elements; probe fed patch antenna elements; linear polarized antenna element and circular polarized antenna elements.

8. The antenna array structure of claim 1 wherein the RIFA units of the wide beam forming antenna array are polarized in a direction that is normal to a plane of the array reflector.

9. The antenna array structure of claim 1 wherein each RIFA unit comprises:

a feed portion electrically coupling the RIFA unit to an RF feed;

at least a first selective grounding portion and a second selective grounding portion, each selective grounding portion being configured to selectively enable or disable an electrical coupling to a ground plane of the planar array reflector;

a first conductive arm providing electrical conduction between the feed portion and the first selective grounding portion, extending from the first selective grounding portion towards the feed portion and extending beyond the feed portion; and at least a second conductive arm providing electrical conduction between the feed portion and the second selective grounding portion, extending from the second selective grounding portion towards the feed portion and extending beyond the feed portion;

the feed portion, the first selective grounding portion and the first conductive arm together defining a first inverted F antenna (IFA) element of the RIFA unit;

the feed portion, the second selective grounding portion and the second conductive arm together defining at least a second IFA element of the RIFA antenna unit;

the feed portion being common to both the first and at least the second IFA elements.

10. The antenna array structure of claim 9 wherein the first and second IFA elements are polarized in a direction that is normal to a plane of the array reflector, and oriented to propagate in opposing directions.

11. The antenna array of claim 10 wherein the central scan angle range is not more than +/−40° relative to the propagation axis that is normal to the array reflector.

12. The antenna array of claim 11 wherein the wide angle scan range is from not less than 35° to not more than 75° and from not more than −35° to not less than −75° relative to the propagation axis that is normal to the array reflector.

13. The antenna array structure of claim 1 comprising a controller configured to independently adjust a phase and an amplitude of an RF signal for each of a plurality of first antenna elements that are included in the central beam forming antenna array and each of the RIFA units that are included in the wide beam forming antenna array to cause the antenna array structure to form a collective RF signal having a beam peak that corresponds to a desired propagation angle.

14. The antenna array structure of claim 13 wherein the controller is configured to use the central beam forming antenna array to form the collective RF signal when the desired propagation angle falls within the central scan angle range and to use the wide beam forming antenna array to form the collective RF signal when the desired propagation angle falls within the wide scan angle range.

15. The antenna array structure of claim 14 wherein the controller is configured to use both the central beam forming antenna array and the wide beam forming antenna array to form the collective RF signal when the desired propagation angle falls within a scan angle range that is within an overlapping region of the central scan angle range and the wide scan angle range.

16. The antenna array structure of claim 13 wherein the controller is configured to use only the central beam forming antenna array to form the collective RF signal when the desired propagation angle falls within the central scan angle range and to use only the wide beam forming antenna array to form the collective RF signal when the desired propagation angle falls within the wide scan angle range.

17. A method of transmitting an RF signal using an antenna array structure that comprises a planar array reflector; a central beam forming antenna array located on the planar array reflector and configured to form radio frequency (RF) signals having a beam peak that is adjustable within a central scan angle range relative to a propagation axis that is normal to the array reflector; and a wide beam forming antenna array located on the surface of the planar array reflector and configured to form RF signals with a beam peak that is adjustable within a wide angle scan range that at least partially exceeds the central scan angle range, wherein the wide beam forming antenna array includes an array of configurable reversible inverted F-antenna (RIFA) units, the method comprising:

selecting at least one of the central beam forming antenna array and the wide beam forming antenna array based on a desired propagation angle; and adjusting the amplitude and phase of RF signals provided to antenna elements of the selected antenna array to achieve the desired propagation angle for transmitting the RF signal.

18. The method of claim 17 wherein selecting at least one of the central beam forming antenna array and the wide beam forming antenna array based on a desired propagation angle comprises: if the desired propagation angle falls with the central scan angle range then selecting the central beam forming antenna and if the desired propagation angle falls outside of the central scan angle range then selecting the wide scan angle array.

19. The method of claim 18 wherein the central scan angle range is not more than +/−40°.

* * * * *